US005938394A

United States Patent [19]

Christenson

[11] Patent Number: 5,938,394

[45] Date of Patent: Aug. 17, 1999

[54] COLLECTION APPARATUS

[75] Inventor: Ronald E. Christenson, Parsons, Tenn.

[73] Assignee: McNeilus Truck and Manufacturing, Inc., Dodge Center, Minn.

[21] Appl. No.: 09/063,248

[22] Filed: Apr. 20, 1998

Related U.S. Application Data

[62] Division of application No. 08/480,902, Jun. 8, 1995, Pat. No. 5,797,715.

[51] Int. Cl.[6] ..... B65F 3/04

[52] U.S. Cl. ..... 414/408; 414/406; 414/501; 414/555; 414/735; 220/1.5

[58] Field of Search ..... 414/403, 421, 414/406, 407, 408, 409, 546, 555, 800, 812, 735; 220/1.5

[56] References Cited

U.S. PATENT DOCUMENTS

| | | | |
|---|---|---|---|
| Re. 34,292 | 6/1993 | Bingman et al. . | |
| 3,841,508 | 10/1974 | Ebeling et al. . | |
| 3,964,624 | 6/1976 | Werder . | |
| 4,091,944 | 5/1978 | Gollnick . | |
| 4,096,959 | 6/1978 | Schaffler . | |
| 4,175,903 | 11/1979 | Carson . | |
| 4,227,849 | 10/1980 | Worthington . | |
| 4,230,359 | 10/1980 | Smith . | |
| 4,345,868 | 8/1982 | Rizzo et al. . | |
| 4,363,588 | 12/1982 | Stickney . | |
| 4,401,407 | 8/1983 | Breckenridge . | |
| 4,461,608 | 7/1984 | Boda . | |
| 4,566,840 | 1/1986 | Smith | 414/408 |
| 4,575,300 | 3/1986 | George . | |
| 4,669,940 | 6/1987 | Englehardt et al. . | |
| 4,708,570 | 11/1987 | Smith et al. . | |
| 4,715,767 | 12/1987 | Edelhoff et al. . | |
| 4,722,658 | 2/1988 | Wurtz et al. . | |
| 4,726,726 | 2/1988 | Dossena et al. . | |
| 4,741,658 | 5/1988 | Zelinka et al. . | |
| 4,844,682 | 7/1989 | Edelhoff . | |
| 4,872,801 | 10/1989 | Yeazel et al. . | |
| 4,909,564 | 3/1990 | Pfeifer et al. . | |

(List continued on next page.)

FOREIGN PATENT DOCUMENTS

| | | |
|---|---|---|
| A6023190 | 2/1991 | Australia . |
| B4192193 | 9/1993 | Australia . |
| A2 0312900 | 4/1989 | European Pat. Off. . |
| 405428 | 1/1991 | European Pat. Off. . |
| 897650 | 1/1982 | U.S.S.R. . |
| 1110724 | 8/1984 | U.S.S.R. . |
| 1211581 | 11/1970 | United Kingdom . |
| WO 9105721 | 5/1991 | WIPO . |
| WO 9201612 | 2/1992 | WIPO . |
| WO 9421540 | 9/1994 | WIPO . |

*Primary Examiner*—Frank E. Werner
*Attorney, Agent, or Firm*—Nikolai, Mersereau & Dietz, P.A.

[57] ABSTRACT

A refuse collection apparatus including a container lifting and emptying apparatus connected to a collection receptacle which is dumped into a refuse hauling vehicle. The container lifting and emptying apparatus includes a container manipulator attached to a support arm which is connected to an extensible boom which is, in turn, connected to the collection receptacle. The container manipulator engages a container of interest and the support arm pivots the engaged container between a lowered position and a raised position for dumping. The collection receptacle typically includes multiple compartments wherein the support arm includes a pendulum pivot or is pivotally attached to the collection receptacle such that the engaged container may be tilted over any one of a plurality of the storage compartments. Another version of the collection apparatus includes a collection receptacle having three or four compartments wherein one compartment is adjacent and between the manipulator and a far storage compartment. The support arm includes a collapsing parallelogram arm construction which is retracted to address the adjacent or near compartment and extended to address the far compartment.

14 Claims, 14 Drawing Sheets

U.S. PATENT DOCUMENTS 4,911,600 3/1990 Zelinka et al. .
4,983,092 1/1991 Richards .
4,986,074 1/1991 Hahmann et al. .
5,015,142 5/1991 Carson ..... 414/408
5,018,929 5/1991 Carson .
5,026,104 6/1991 Pickrell .
5,033,930 7/1991 Kraus .
5,035,563 7/1991 Mezey .
5,044,863 9/1991 LaBass et al. .
5,049,026 9/1991 Bingman et al. .
5,059,081 10/1991 Brown et al. .
5,064,332 11/1991 Edelhoff et al. .
5,069,593 12/1991 Zelinka et al. .
5,071,303 12/1991 Carson .
5,071,307 12/1991 Carson .
5,074,737 12/1991 Pellegrini et al. .
5,078,567 1/1992 Lombardo .
5,092,731 3/1992 Jones et al. .
5,094,582 3/1992 Molzhon .
5,098,250 3/1992 Carson .
5,114,304 5/1992 Edelhoff et al. .
5,122,025 6/1992 Glomski .
5,163,805 11/1992 Mezey .
5,205,698 4/1993 Mezey .
5,209,537 5/1993 Smith et al. .
5,222,853 6/1993 Carson .
5,230,393 7/1993 Mezey .
5,244,218 9/1993 Irwin, Sr. ..... 414/408 X
5,303,841 4/1994 Mezey .
5,308,211 5/1994 Bayne .
5,330,308 7/1994 Armando et al. .
5,333,984 8/1994 Bayne et al. .
5,360,310 11/1994 Jones et al. .
5,391,039 2/1995 Holtom ..... 414/421 X
5,447,405 9/1995 Bayne et al. .
5,484,245 1/1996 Zopf ..... 414/406 X
5,607,277 3/1997 Zopf .
5,613,822 3/1997 Gasparini et al. ..... 414/408
5,613,823 3/1997 Bayne .
5,639,201 6/1997 Curotto ..... 414/408
5,762,462 6/1998 Bayne .
5,784,947 7/1998 Bayne et al. .
5,826,485 10/1998 Bayne et al. .

COLLECTION APPARATUS

This application is a divisional of Ser. No. 08/480,902, filed Jun. 8, 1995, now U.S. Pat. No. 5,797,715 entitled "A COLLECTION APPARATUS".

BACKGROUND OF THE INVENTION

I. Field of the Invention

The invention relates generally to material handling equipment and, more particularly, to a refuse collection apparatus including a collection receptacle and integral container lifting and emptying apparatus for use during collection efforts.

II. Related Art

Recyclable refuse must be separated from that which is not recycled at some point in the collection process. Separation may conveniently be made at the point of collection. To this end, refuse collection systems have been built which include vehicles and material collection and storage receptacles having a plurality of compartments wherein each compartment is dedicated to a particular type or types of refuse. Types of refuse typically separated include glass, aluminum, plastic, paper and non-recyclable material. In these point of collection systems, refuse is deposited into dedicated compartments in the collection and storage receptacle which is, in turn, unloaded into a corresponding compartment in the collection vehicle container.

A multi-compartment vehicle for unloading and receiving the contents of corresponding multi-compartment collection receptacles is described and shown in U.S. patent application Ser. No. 08/389,097, filed Feb. 15, 1995, now abandoned, titled "Multiple Compartment Body for Waste Materials", by Ronald E. Christenson, the inventor herein, which is assigned to the same assignee as the present invention and the disclosure of which is hereby incorporated by reference for any necessary purposes. That application describes a refuse hauling vehicle including a multi-compartment truck body and a front or side loading, fork-type, lift and dump mechanism which lifts and dumps a multi-compartment collection receptacle into the receiving hopper of the truck body. The collection receptacle is of the large hopper, free standing dumpster variety which is periodically unloaded at the point of collection and remains on-site.

Other containers of the multi-compartment class are found in U.S. Pat. Nos. 5,071,303 and 5,222,853, issued to Carson, which describe a multi-compartment collection receptacle having a plurality of dedicated compartments with corresponding locking lids. During the dumping operation, a collection receptacle compartment is positioned above a corresponding dedicated compartment in a multi-compartment vehicle and the lid is opened to release the refuse contained therein into the vehicle. A collection receptacle lifting mechanism is mounted on the vehicle body on a rail in a manner that allows it to slide along the length thereof to index or position the collection receptacle as required for unloading.

U.S. Pat. Nos. 5,035,563; 5,163,805; 5,205,698; and 5,303,841, issued to Mezey, illustrate side loading or front loading, multi-compartment refuse vehicles used in conjunction with corresponding multi-compartment collection receptacles or single compartment containers. The vehicles include either a side loading container grabber and lifter or a front loading, fork-type, receptacle lift and dump mechanism. The collection receptacles and containers are manually loaded and mechanically lifted above and inverted over the multi-compartment vehicle for unloading. In one system, a side loading container grabber and lifter is slidably attached to a multi-compartment vehicle or trailer for movement along the length thereof which enables the device to dump a single compartment container into a selected one of several separate trailer compartments.

A somewhat different approach is described and shown in U.S. Pat. No. 5,308,211, issued to Bayne, in which a collection receptacle itself is provided with an attached refuse cart tipper for unloading smaller containers or cans of interest into the receptacle which may, in turn, be emptied into a larger refuse hauling vehicle having a fork-type lift and dump mechanism. However, that cart tipper is not able to empty the smaller container into a selected one of a plurality of compartments in a multi-compartment collection receptacle and the smaller container must be manually loaded onto the cart tipper.

Heretofore, container lifting and emptying devices have not been built to selectively position a container above a plurality of compartments in a collection receptacle. U.S. Pat. Nos. 4,401,407, issued to Breckenridge, and 5,026,104, issued to Pickrell, describe and show grasping devices connected to extensible boom systems which may be lifted to raise an engaged container above one position along the length of a refuse vehicle. However, neither the grasping device and support arm nor the extensible boom situate the engaged container above a plurality of positions along the length of the truck.

U.S. Pat. No. 5,330,308, issued to Armando et al, describes an automatic container lifting and emptying apparatus including an extensible boom which can pivot vertically to raise an engaged container above the refuse vehicle and horizontally to pivot the container in a partial circle as it is positioned above the truck body. However, that system has limited versatility and cannot situate the container above more than one position along the length of the truck body and although it is provided with an attached grasping device which can pivot in a circle at the end of the extensible boom along an axis transverse to the direction of travel of the telescoping boom, the device cannot address a plurality of positions along the length of the truck body.

The separation of materials at the point of collection is becoming, and in the future will become an even more important consideration in the disposal of refuse. Consequently, a collection apparatus including a container lifting and emptying apparatus which can dump containers into a plurality of compartments in an attached collection receptacle and which does not require translation along the length thereof is needed to address the separation of recyclable materials.

OBJECTS

It is accordingly a principal object of the invention to provide an improved material collection system.

Another object of the invention is to provide a collection system wherein either a collection receptacle or a smaller container may be automatically lifted and emptied.

Yet another object of the invention is to provide a collection system wherein the integrity of loads of segregated material is maintained.

Still another object of the invention is to provide a collection apparatus which includes a collection receptacle and an attached container lifting and emptying apparatus for automatically unloading a container into the collection receptacle.

Still yet another object of the invention is to provide a collection apparatus which is detachable from a vehicle and includes a multi-compartment collection receptacle and a container lifting and emptying apparatus for unloading a smaller container into a selected one of a plurality of receptacle compartments.

A further object of the invention is to provide an indexing container lifting and emptying apparatus with the ability to situate an engaged container above a plurality of positions along the length of a collection receptacle.

A still further object of the invention is to provide an indexing container lifting and emptying apparatus with the ability to situate an engaged container above a plurality of positions along the length and across the width of a collection receptacle.

Yet a still further object of the invention is to provide a pendulum support arm in a container lifting and emptying apparatus for pivoting between a plurality of container positions along the length of a collection receptacle.

Other objects, features and advantages of the present invention will become apparent to those skilled in the art through familiarity with the summary of the invention, detailed description, claims, and drawings herein.

SUMMARY OF THE INVENTION

The foregoing objects are among those attained by the present invention which provides a collection apparatus including a container lifting and emptying apparatus attached to a collection receptacle which itself is designed to be carried by a lift and dump mechanism of a refuse hauling vehicle. The container lifting and emptying apparatus automatically lifts and empties smaller containers into the collection receptacle. The collection apparatus is normally carried by the lift and dump mechanism of a truck but may be as a truck body or detached from the vehicle and left on-site for re-loading at the point of collection. When carried by a truck or used as a truck body the system is carried from site to site for emptying smaller containers.

The collection receptacle includes at least one compartment and typically includes multiple compartments which may be dedicated to receive a specific material or group of materials, such as glass, aluminum, plastic, paper or non-recyclable material. The compartments are further positioned such that when the collection receptacle is dumped into a compatible and corresponding multi-compartment body the integrity of the load of segregated material is maintained intact. The collection receptacle compartments may be configured to correspond to any refuse hauling vehicle, including both front and side loading vehicles, and the collection receptacle may have any number of compartments.

In the examples described herein the receptacle is provided with from two to four compartments which are either automatically or manually loaded over relatively low sides. The collection receptacle may also include a side or corner pocket for item which are manually loaded and a cover for each compartment, such as a removable hinged cover or a tarp. Lift mounts or handles which correspond to the type of lift and dump mechanism used on the hauling vehicle are attached to each side of the collection receptacle. In the examples described herein, the mounts are tubular fork mounts which receive the forks of a fork-type lift and dump mechanism.

The container lifting and emptying apparatus may be of any type for automatically dumping a smaller container into the attached collection receptacle. In the apparatus described herein, a container manipulator for securely holding a container of interest is attached to a support arm which includes a pivot for pivoting the manipulator between a lowered position and a raised or dump position. The support arm is further pivoted or pivotally attached to the collection receptacle such that the container manipulator is mounted on a pendulum lever for pivoting about a pendulum fulcrum to adjust the attitude of the manipulator along the length of the collection receptacle to selectively position an engaged container above one of the plurality of compartments.

In accordance with the plurality of illustrated embodiments of the present invention described herein, the collection receptacle includes a plurality of compartments and an extensible boom is situated at the interface of two of the compartments or in one compartment. A support arm is connected to the inside arm of the extensible boom and a container manipulator is attached to the support arm which pivots or tilts to adjust the attitude of the manipulator and the point of discharge of an engaged container. Of course, the boom may be extended to position the manipulator around a container of interest which may be remote from the collection receptacle such that the manipulator extends to the container for unloading.

The manipulator may be connected to the collection receptacle in any of a number of ways for pivotally adjusting the attitude of the engaged container above a plurality of compartments. In one embodiment described herein, a support arm is pivotally attached to the inner boom arm of the extensible boom to pivot the support arm along the side of the collection receptacle. The manipulator is attached to the support arm which includes a hinge or pivot between the inner boom arm and the manipulator to pivot between the lowered and raised positions. A fluid operated actuator, such as an hydraulic cylinder, is connected to the inner boom arm and the support arm to pivot the support arm about the inner boom arm and adjust the attitude of the manipulator to position the engaged container.

In another embodiment, the extensible boom is pivotally attached along the length thereof to the collection receptacle such that the boom tilts from side to side. A support arm is securely mounted to the inner boom arm and carries the manipulator between the raised and lowered positions. A linear actuator is attached to the collection receptacle and the extensible boom to tilt the boom and pivot the support arm and manipulator such that, in the raised position, the manipulator is pivotally adjusted along the length of the collection receptacle to position the engaged container above the compartments.

In yet another embodiment, the extensible boom is securely attached to the collection receptacle and a support arm is securely attached to the inner boom arm. The support arm includes a first pivot for pivoting the manipulator between the lowered and raised positions and a second pivot, spaced from the manipulator, that pivots a portion of the support arm and the manipulator like a pendulum.

In another aspect of the invention, a collection receptacle has three or more compartments which are automatically loaded by a container lifting and emptying apparatus. Two of the compartments, an adjacent or near and a far compartment, are situated to one side of an extensible boom and at least one compartment is situated to the other side. A support arm which carries a container manipulator is connected to the extensible boom such that the adjacent or near compartment is between the support arm and the far compartment. The support arm includes a base arm attached to the extensible boom and a parallelogram arm pivotally attached to the base arm for pivoting between the raised and lowered positions. The parallelogram arm includes a linear actuator, such as an hydraulic cylinder, to retract the parallelogram arm and situate an engaged container above the near compartment or extend the parallelogram arm to reach the far compartment. The support arm base is securely attached to a tilting extensible boom or, as described herein, the arm base is pivotally attached to the inner boom arm.

In operation, in each embodiment, a container of interest is engaged by the container manipulator by extending the extensible boom and operating the manipulator. The extensible boom is retracted and the support arm is operated to raise the engaged container above the collection receptacle. At the same time, one or more linear actuators operate to position the container of interest above a collection receptacle compartment. The operation is reversed to return the container to its resting position.

DETAILED DESCRIPTION

The apparatus of the present invention generally includes a container lifting and emptying apparatus connected to a collection receptacle which is carried by a lift and dump mechanism of a load hauling vehicle. The container lifting and emptying apparatus is for engaging and unloading a container of interest into one of a plurality of compartments in the collection receptacle and includes a container manipulator attached to a support arm which is connected to an extensible boom. The container lifting and emptying apparatus is typically hydraulically operated and powered by the hydraulic system of the load hauling vehicle. It will be appreciated that, in each embodiment described herein, the container manipulator used may be any manipulator capable of grasping and holding a container during the lift and dump operation. Examples of manipulators which may be used include those described and shown in U.S. patent application Ser. No. 08/342,752, filed on Nov. 21, 1994, now abandoned, titled "Container Lifting and Holding Device", and U.S. patent application Ser. No. 08/411,494, filed Mar. 28, 1995, now abandoned, titled "Tilting Bin Handler", which includes an extensible boom. Both of these applications are by Ronald E. Christenson, the inventor herein, and are assigned to the same assignee as the present invention and both disclosures are hereby incorporated by reference for any necessary purposes.

Figure 1:
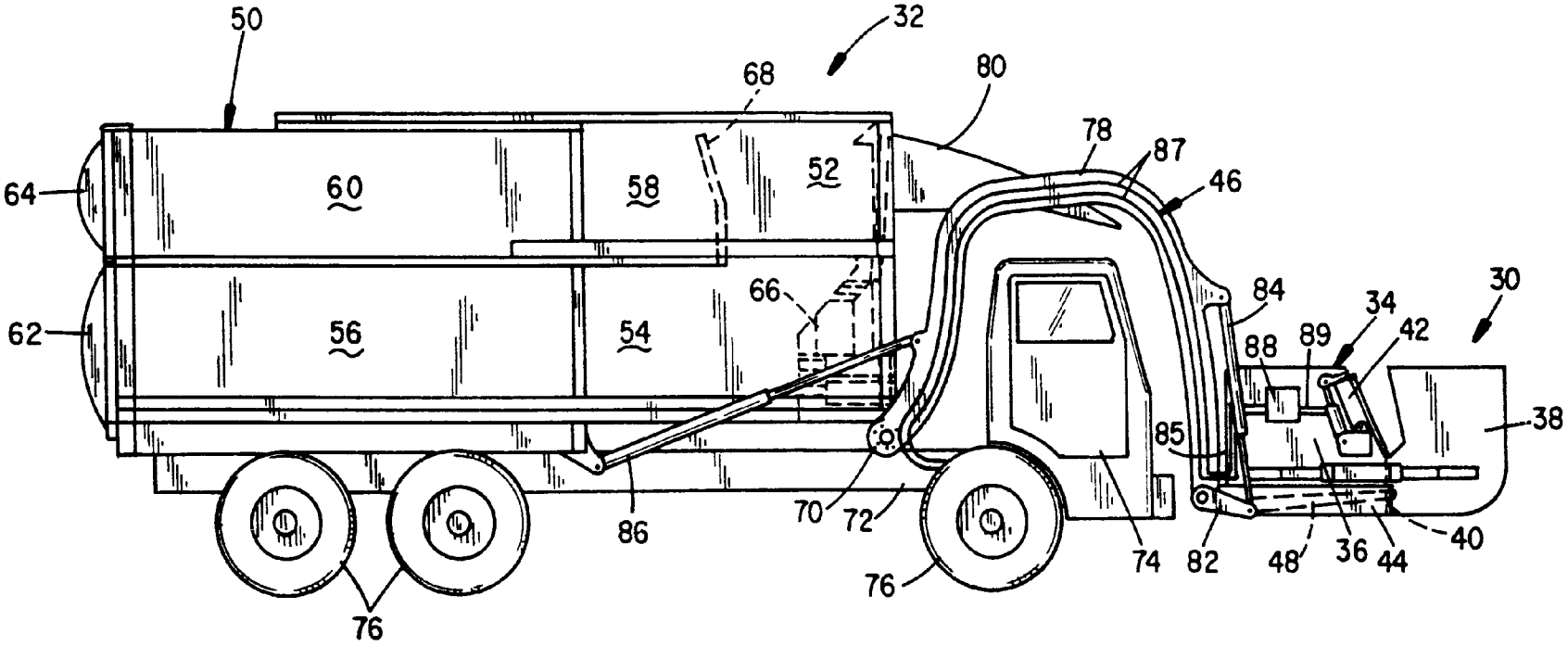
FIG. 1 is a side view of a multi-compartment hauling vehicle of the front loading variety carrying a collection apparatus of the present invention.

A collection apparatus in accordance with the present invention and indicated generally by the numeral 30 is shown in FIG. 1 being carried by a front loading refuse hauling vehicle, generally at 32, wherein the sides of the front loading vehicle 32 are removed to show the interior details. The collection apparatus 30 includes a collection receptacle 34 having a forward storage compartment 38 and a rear storage compartment 36 separated by a vertical wall 40. A container lifting and emptying apparatus 42 is connected to the collection receptacle 34 for unloading containers, such as refuse cans or bins, into the forward and rear compartments 38 and 36.

Collection apparatus of the invention described herein include the necessary devices or system to connect to a source of pneumatic or hydraulic fluid power to operate any on-board systems in a conventional fashion. Such a system for hydraulics may include hydraulic fluid lines and valve control lines, generally at 85, connected to control valves 88 attached to the apparatus 30. The control valves 88 direct hydraulic fluid to the container lifting and emptying apparatus 42 through hydraulic fluid lines 89. The hydraulic system is operated by control valve operators, typically either electric or pneumatic, wherein the controls for operating the container lifting and emptying apparatus 42 may be situated in a cab section 74 of the vehicle 32 or on the collection apparatus 30. The hydraulic or pneumatic fluid lines as at 85 and hydraulic or pneumatic fluid supply lines as at 87 may be connected as by a quick-connect type line connector.

The collection apparatus of the invention also includes a tubular fork receiving handle or mount 44 attached to each side of the collection receptacle or bin 34 for receiving carrying forks on a compatible vehicle that carry the apparatus 30 during collection efforts and lift and dump the loaded apparatus 30 into a refuse receiving body such as that carried by the front loading refuse vehicle 32. A lift and dump mechanism 46 pivotally attached to the vehicle 32 includes lifting forks 48 which correspond with and are slidably inserted into the tubular fork receiving mounts 44.

Ease of connection and disconnection of the collection apparatus 30 to the vehicle 32 represents an aspect of the invention. Lifting forks 48 are aligned with the tubular fork receiving mounts 44 and the vehicle 32 is simply driven forward to insert the forks 48 into the mounts 44. The fluid supply lines and control lines 85 can then be connected to the corresponding supply lines and control lines 87 using quick-connect devices. Of course, the collection apparatus 30 may be disconnected by simply reversing the process.

Figure 2:
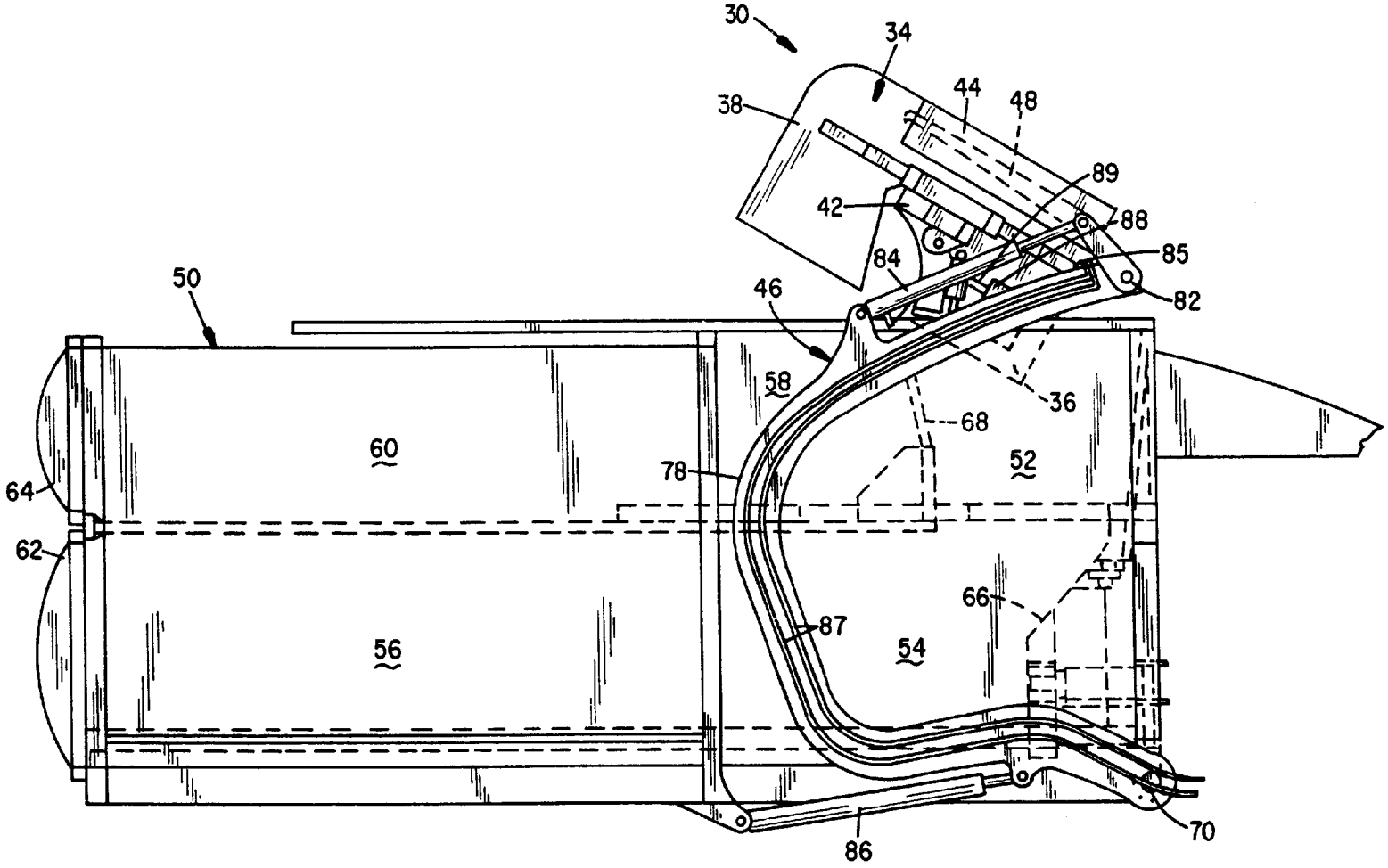
FIG. 2 depicts an enlarged partial view of the vehicle of FIG. 1 with the collection apparatus in the dump position.

As shown in FIGS. 1 and 2, the front loading refuse hauling vehicle 32 includes a refuse hauling body 50 which is divided into a forward section 52 which connects with a lower loading hopper 54 and a lower storage body 56. An upper loading hopper 58 has a receiving opening rearward of the lower loading hopper 54 and is connected to an upper storage body 60. The lower and upper storage bodies 56 and 60 are provided, respectively, with top hinged arcuate tailgates 62 and 64. These tailgates 62 and 64 absorb the forces of compaction and contain a pressurized load when closed. To unload either of these storage bodies 56 or 60, the corresponding tailgate 62 or 64 is opened. Each of the loading hoppers 54 and 58 is provided with a packing ram mechanism including a lower panel 66 and an upper panel 68.

The lift and dump mechanism 46 may be conventional and includes identical devices addressing each side of the vehicle 32 and each side of the collection apparatus 30 whereas one side is being depicted in FIGS. 1 and 2. The mechanism 46 includes a heavy lift arm 78 which operates outside a cab protector 80 and is pivotally attached to the body 50 at pivot 70. The body is attached to a frame or chassis 72 which also carries the cab section 74 and wheels 76. A fork lever arm 82 is securely attached to a tubular axle which extends between the heavy lift arm 78 on each side of the vehicle 32 and is secured to each lifting fork 48. A dump fluid-operated actuator or hydraulic cylinder 84 is pivotally attached to the fork lever arm 82 and the heavy lift arm 78. A lift fluid-operated actuator or hydraulic cylinder 86 is pivotally attached to the body 50 and the heavy lift arm 78.

To unload the apparatus 30, lift and dump cylinders 86 and 84 are retracted to position the rear and forward storage compartments 36 and 38 of the collection receptacle 34 above the forward section 52 and the upper loading hopper 58, respectively. The heavy lift arm 78 and dump cylinder 84 are spaced from the lifting fork 48 and do not interfere with the nested container lifting and emptying apparatus 42 or the collection receptacle 34 as the collection apparatus 30 is unloaded. In this manner, the integrity of the load of segregated refuse in the rear and forward storage compartments 36 and 38 is maintained in the lower and upper storage bodies 56 and 60 of the vehicle 32. A hauling vehicle of this type, is described in greater detail in the above referenced U.S. patent application Ser. No. 08/389,097.

As shown in FIGS. 3–6, the collection apparatus 30, which is an example embodiment of the present invention, includes the front and rear storage compartments 38 and 36 separated by a notch 39 and wall 40 such that refuse dumped into each compartment does not intermingle with refuse in the other compartment. The container lifting and emptying apparatus 42 includes a container manipulator 90 attached to a support arm 92 which is pivotally attached to an extensible boom 94 which is, in turn, securely attached to the collection receptacle 34 through the rear storage compartment 36. The extensible boom 94 is a conventional telescoping boom including a boom fluid-operated actuator or hydraulic cylinder 100 connected at 102 to an outer boom arm 96 and having its rod 104 connected at 103 to an inner boom arm 98. Rollers 106 guide the inner boom arm 98 in and out of the outer boom 96 as the boom hydraulic cylinder 100 is operated.

The container manipulator 90 includes spaced arms 110 and 112 which are pivotally attached to a manipulator base 114 at pivots 116 and 118, respectively. Manipulator hydraulic cylinders provided at 120 and 122 are also pivotally attached to the manipulator base 114 at 124 and 126 and to the manipulator arms 110 and 112 at 128 and 130. The hydraulic cylinders 120 and 122 are operated to pivot the manipulator arms 110 and 112 between a retracted or nested position, FIG. 3, and a grasping position, FIGS. 4 and 5.

In accordance with the present invention, the support arm 92 includes a base arm segment 140 which is pivotally attached to the inner boom arm 98 of the extensible boom 94 at pivot joint 142. A base arm hydraulic cylinder 144 is pivotally attached between the inner boom arm 98 at 146 and base arm 140 at 148. Hydraulic cylinder 144 operates to pivot the support arm 92 about pivot 142 toward the forward storage compartment 38 or the rear storage compartment 36. The support arm 92 further includes tipper arm side plates 150 which are attached to the manipulator base 114 and pivotally attached to the base arm 140 at pivot joint 152. A tipper arm hydraulic cylinder 154, FIGS. 5 and 6, is pivotally attached between the base arm 140 at cylinder pivot joint 156 and tipper arm 150 at 158.

Figure 3:
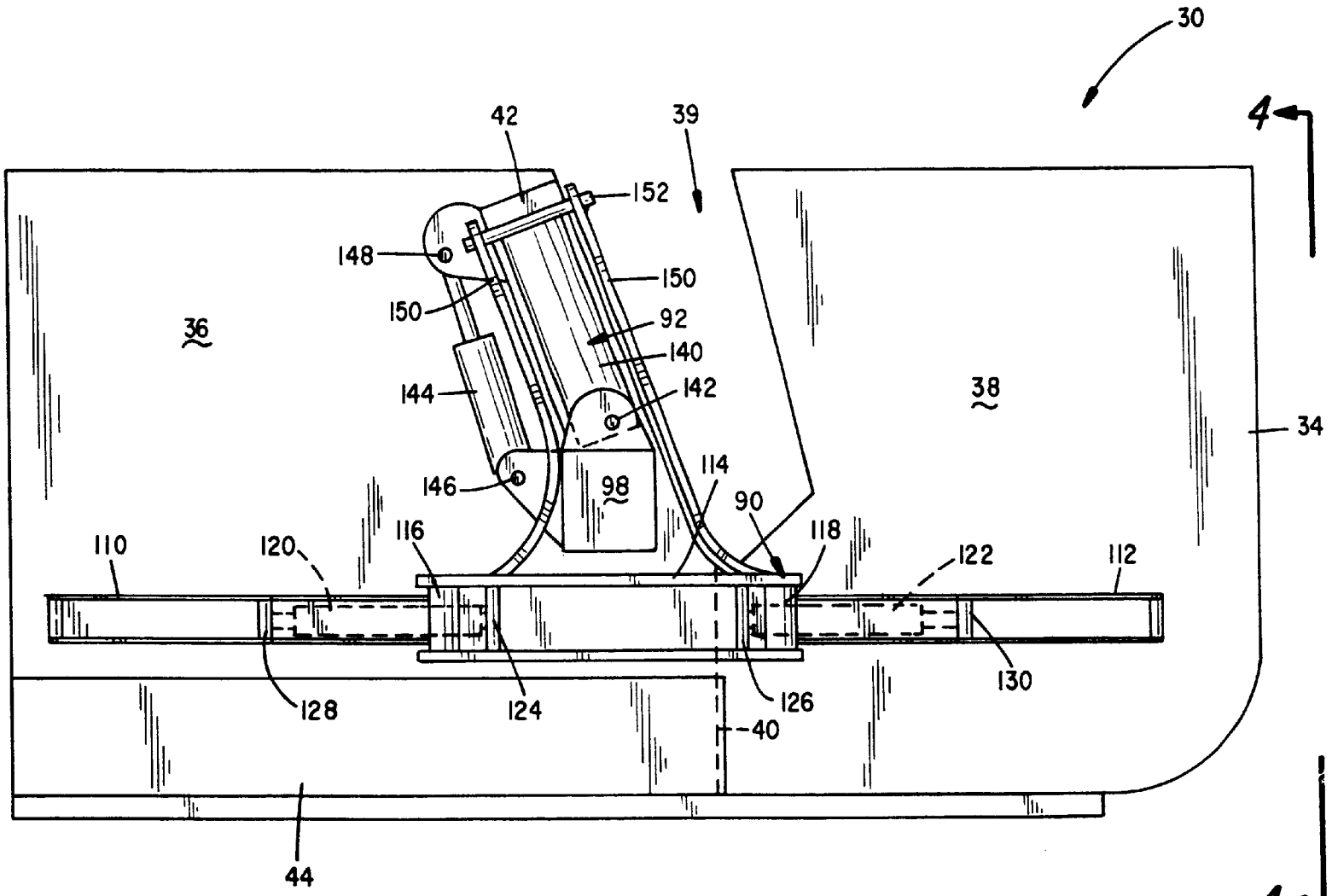
FIG. 3 is a greatly enlarged side view of the collection apparatus of FIGS. 1 and 2 showing a support arm pivotally attached to an extensible boom.

In operation, the support arm 92 may be retracted to a nested position, FIG. 3, when not in use and to accommodate lifting and dumping the collection apparatus 30 as with the lift and dump mechanism 46 on the front loading vehicle 32, FIG. 1. In this position, each of the hydraulic cylinders in the container lifting and emptying apparatus 42 is retracted to its stowed position. In particular, the extensible boom hydraulic cylinder 100 and the tipper arm hydraulic cylinder 154 are retracted to pull the support arm 92 close to the collection receptacle 34. Retracting the manipulator hydraulic cylinders 120 and 122 pulls the manipulator arms 110 and 112 to the open or nested position against the side of the collection receptacle 34. The base arm hydraulic cylinder 144 is retracted to tilt the support arm 92 such that the area between the forward and rear storage compartments 38 and 36 is open. In this position, the container manipulator arms 110 and 112 are parallel with the bottom of the collection receptacle 34 and resting just above the tubular fork receiving mount 44.

Figure 4:
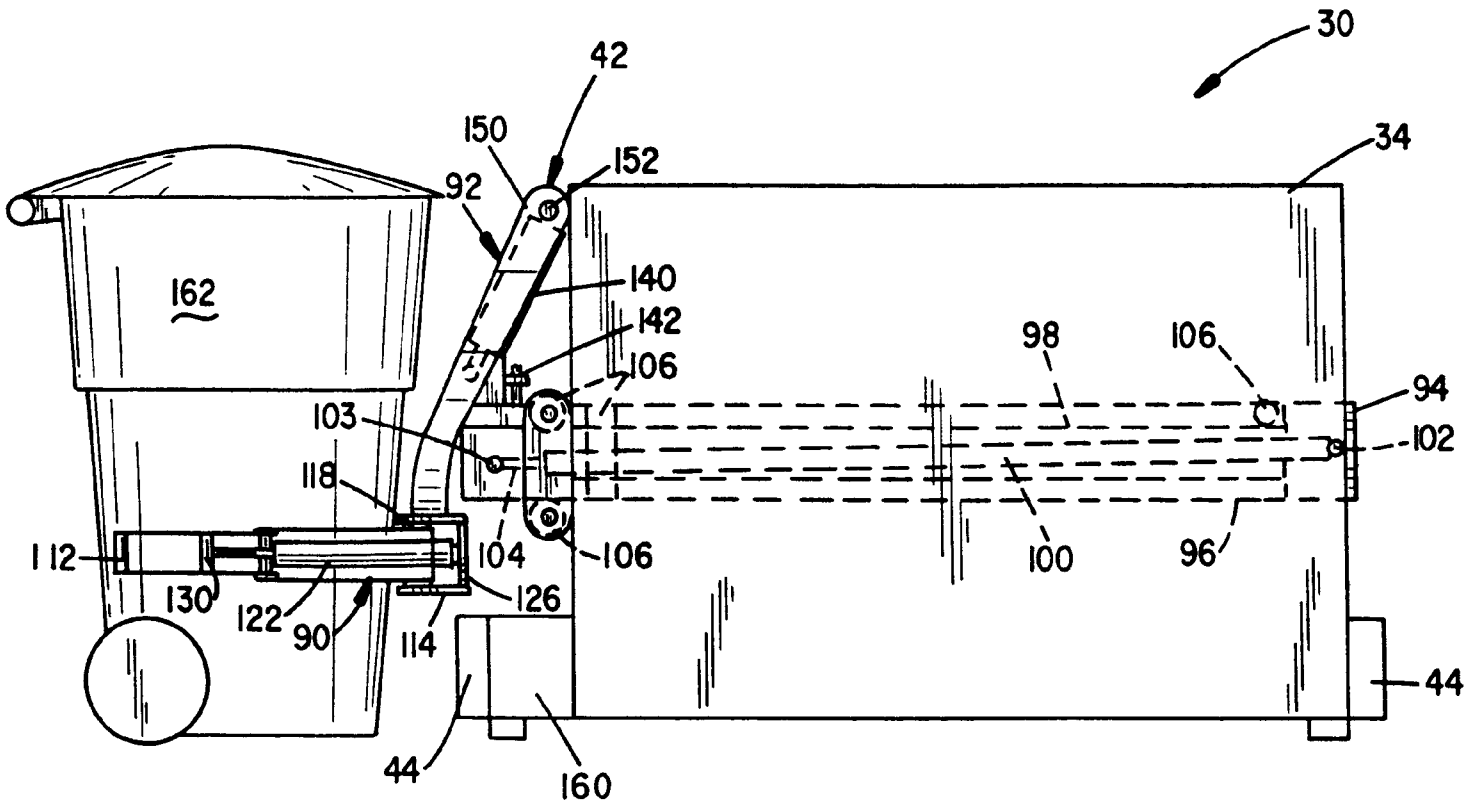
FIG. 4 is a front view taken along the line 4—4 in FIG. 3 showing the container manipulator grasping a container of interest.
Figure 5:
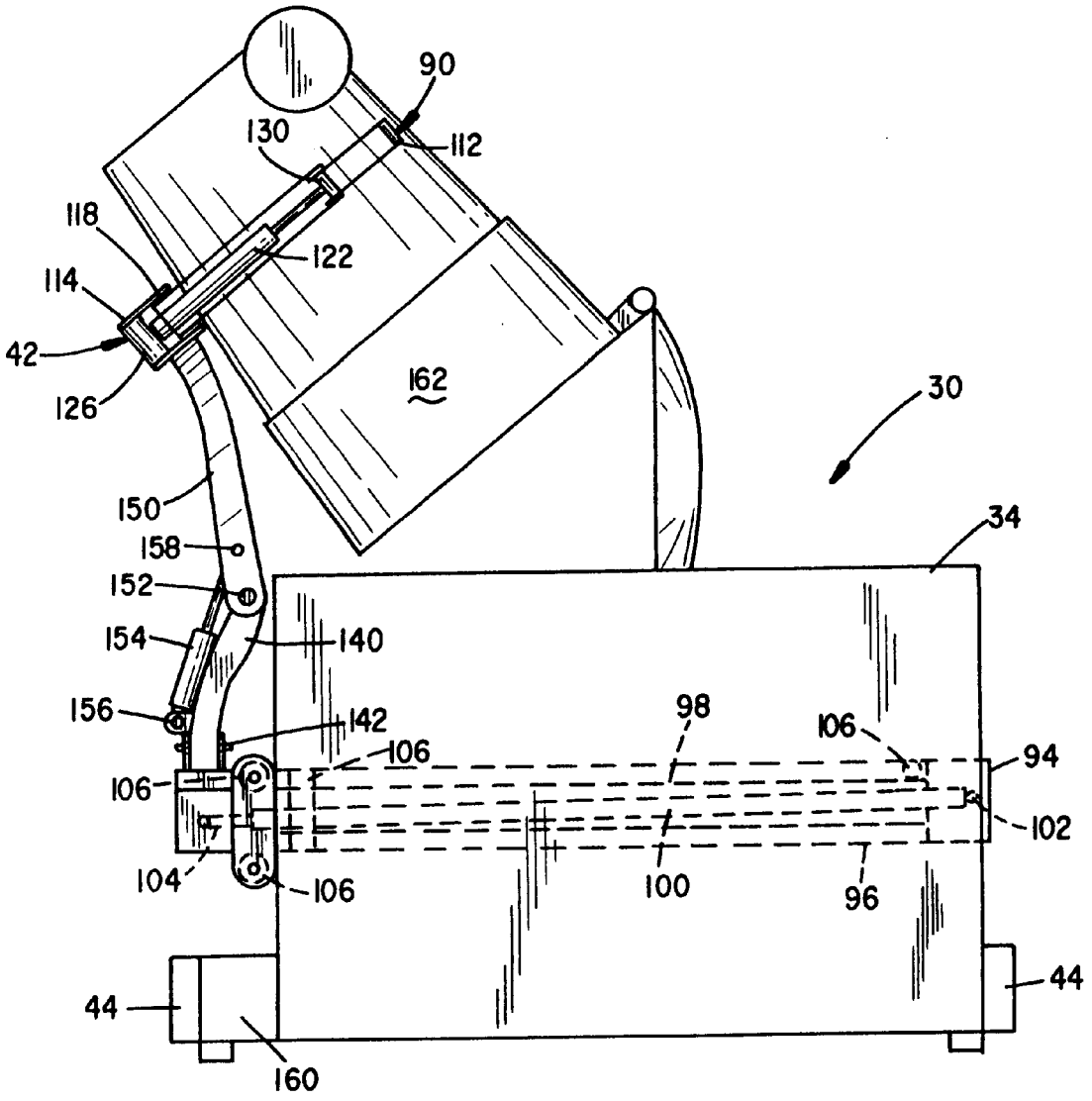
FIG. 5 is a front view of the collection apparatus of FIG. 4 showing the container in the dump position.
Figure 6:
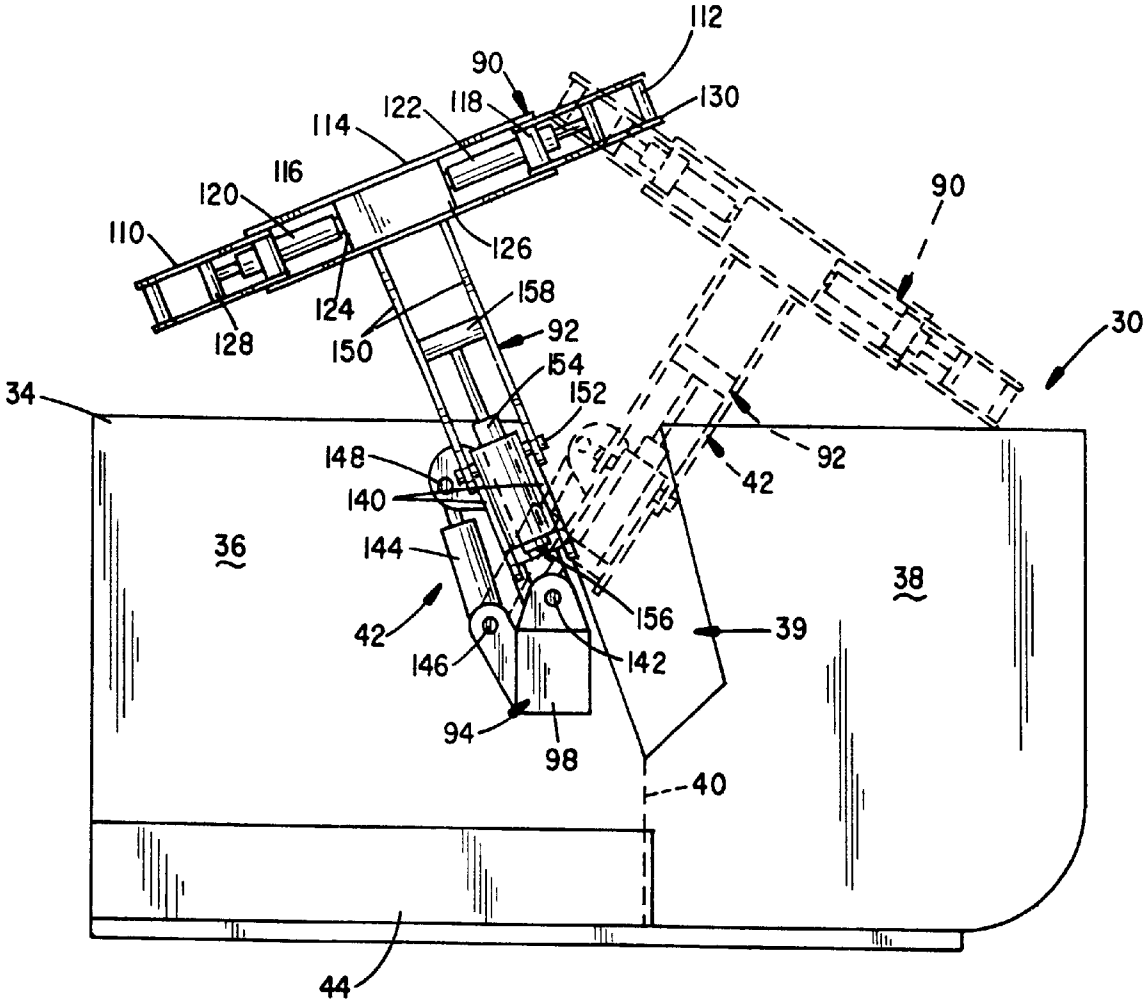
FIG. 6 is a side view of the collection apparatus of FIG. 3 showing the container manipulator in the raised position above one storage compartment in solid lines and the other storage compartment in dashed lines.

As shown in FIGS. 4 and 5, the tubular fork receiving mount 44 on the support arm side of the collection receptacle 34 is attached to a mounting spacer bar 160 which spaces the fork mount 44 from the collection receptacle 34. In the nested position, the container manipulator arms 110 and 112 are situated only slightly further from the collection receptacle 34 than the fork receiving mount 44. Thus, the collection apparatus 30 in the nested position, FIG. 3, may be unloaded by the lift and dump mechanism 46 without encountering the heavy lift arm 78.

Operation of the container mounted lifting and emptying apparatus 42 to empty a container of interest 162 automatically into either the forward storage compartment 38 or the rear storage compartment 36 includes several steps: The container manipulator 90 is first positioned to address the container of interest 162 by positioning the vehicle 32 and extending the boom 94. Manipulator hydraulic cylinders 120 and 122 are then extended to grasp the container 162 and the boom 94 is retracted to position the container 162 next to the collection receptacle 34, FIG. 4. The tipper arm hydraulic cylinder 154 is extended to lift the container 162 above the collection receptacle 34, FIG. 5. At the same time, the base arm hydraulic cylinder 144 is either retracted to dump the container 162 into the rear storage compartment 36 or extended to dump the container 162 into the forward storage compartment 38, as illustrated in FIG. 6 sans the container 162. In this manner, refuse already separated for disposal or recycling is collected and the integrity of the segregated load is preserved.

The container 162 is returned to its resting position by retracting the tipper arm hydraulic cylinder 154 and the base arm hydraulic cylinder 144 to position the container 162 next to the collection receptacle 34. The extensible boom 94 is then extended and the container manipulator hydraulic cylinders 120 and 122 are retracted to release the container 162. of course, a container which is not heavily laden or loose refuse may be manually loaded into the front and rear storage compartments 38 and 36 of the relatively low-sided collection receptacle 34.

Figure 7:
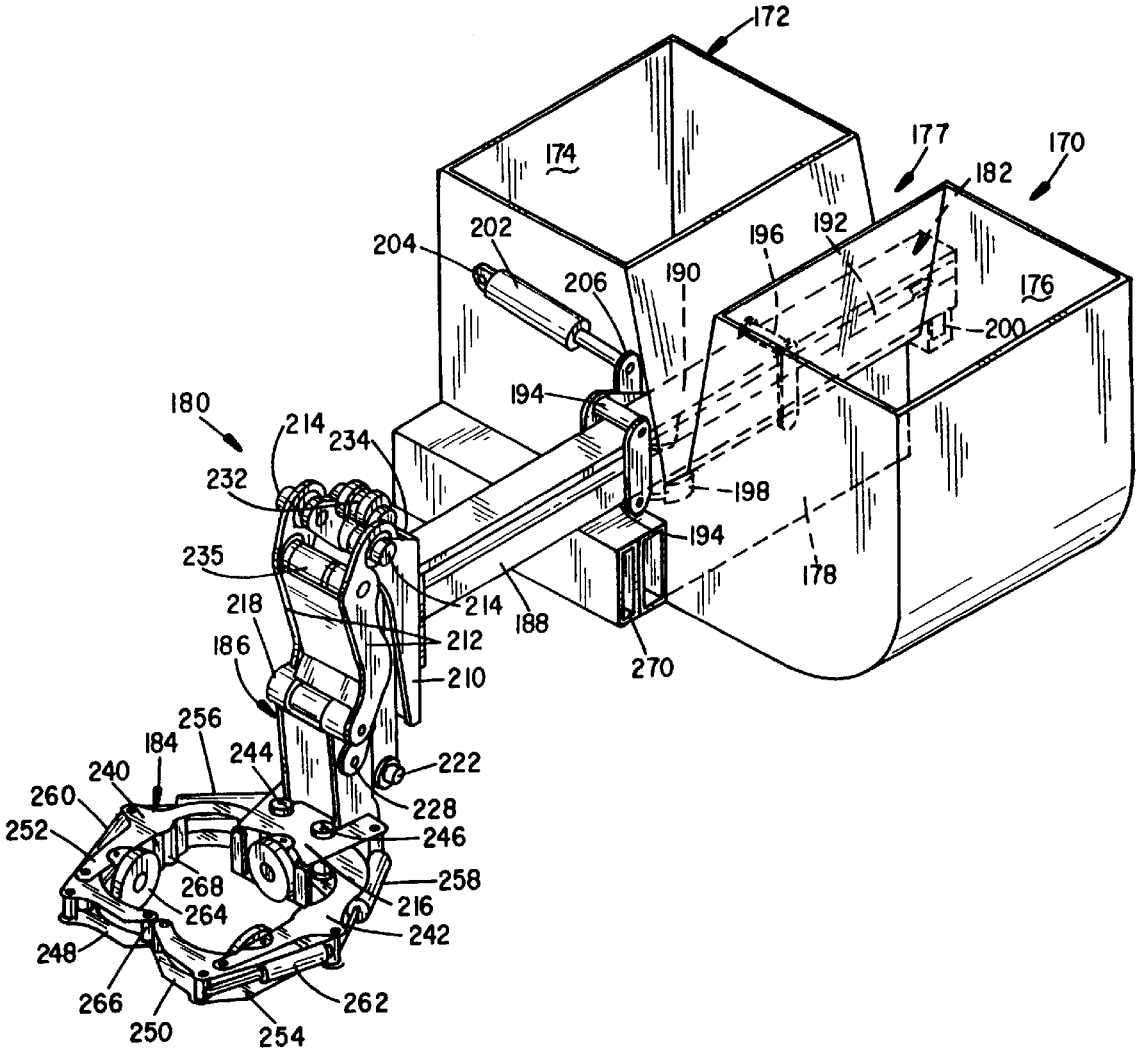
FIG. 7 is a perspective view of another embodiment of a collection apparatus of the invention showing an extensible boom pivotally attached to the collection receptacle.
Figure 8:
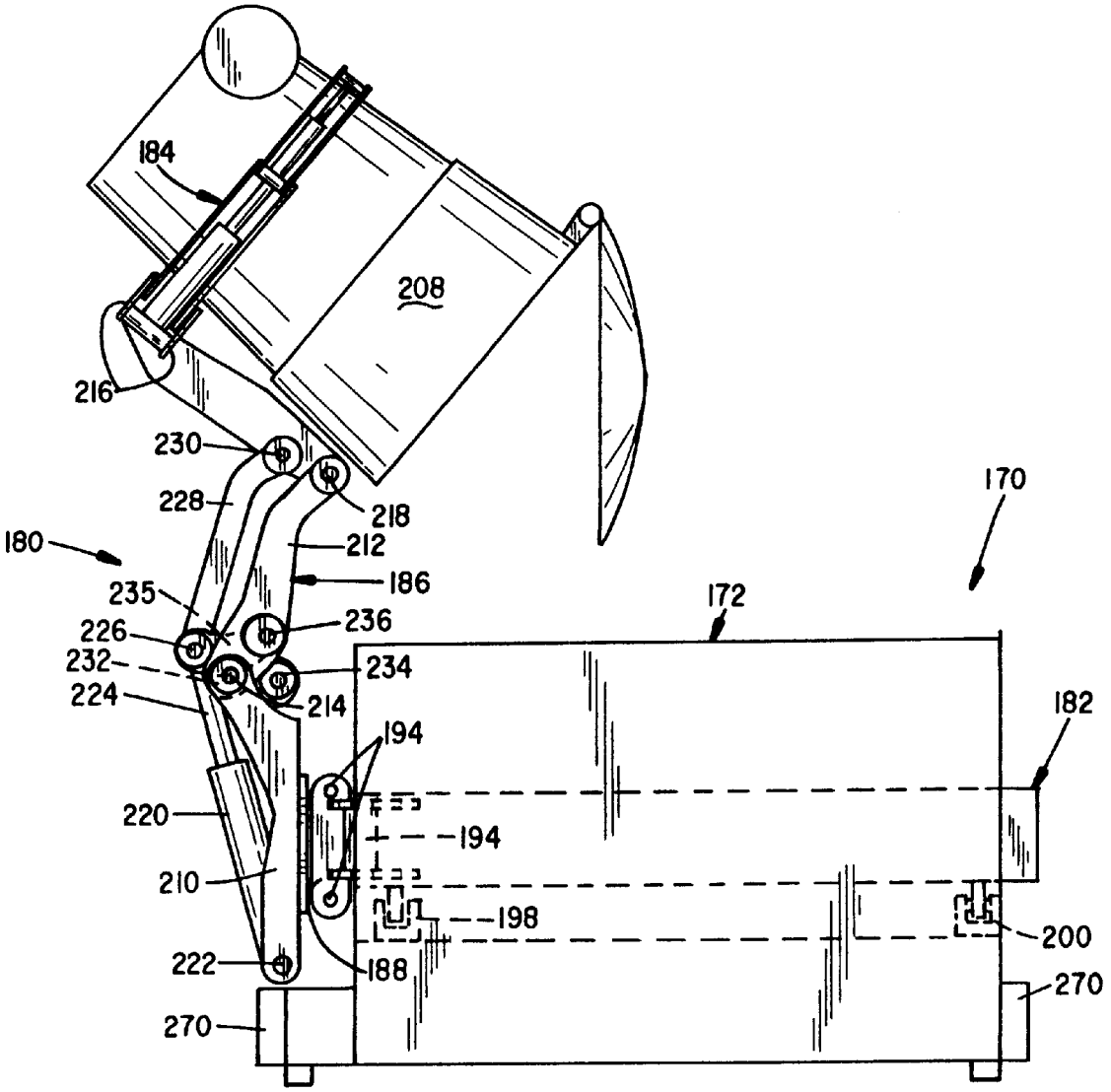
FIG. 8 is a front view of the collection apparatus of FIG. 7 including a container of interest raised above the collection receptacle.
Figure 9:
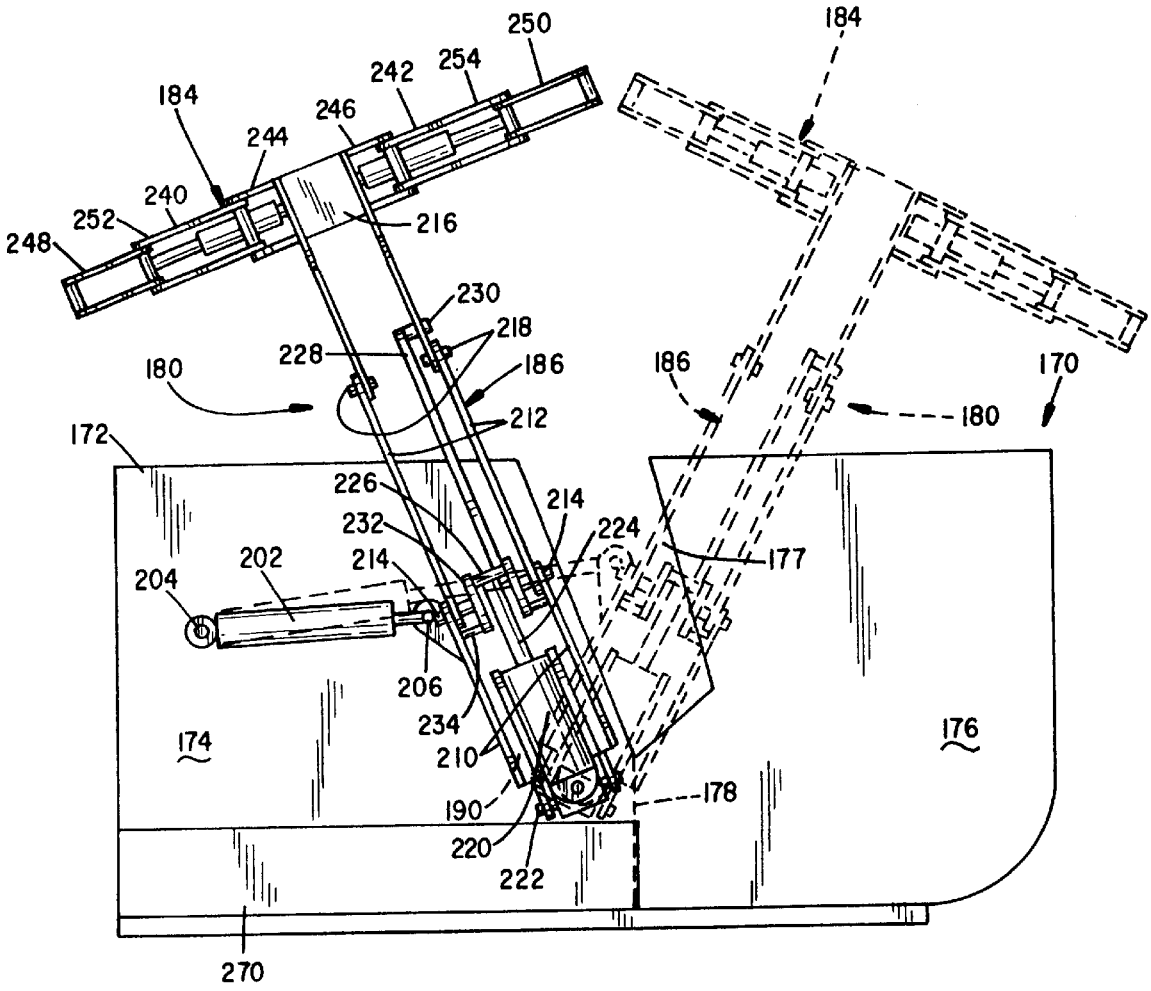
FIG. 9 is a side view of the collection apparatus of FIG. 7 showing the container manipulator in the raised position above one storage compartment in solid lines and the other storage compartment in dashed lines.

In another embodiment, as shown in FIGS. 7–9, a collection apparatus 170 includes a collection receptacle 172 having front and rear storage compartments 176 and 174 separated by a notch 177 and a vertical wall 178. A container lifting and emptying apparatus 180 includes an extensible boom 182 which is pivotally attached to the collection receptacle 172. A container manipulator 184 is attached to a support arm 186 which is securely mounted to the inner boom arm 188 of the extensible boom 182.

The extensible boom 182 is a conventional telescoping boom wherein the inner boom arm 188 is extended from and retracted into an outer boom arm 190 by an hydraulic cylinder 192 attached therebetween. Guide rollers 194 are situated on either side of the outer boom arm 190 to guide the inner boom 188 and a slide roller 196 is rotatably attached to the inner boom arm 188 to make sliding easier.

The extensible boom 182 is pivotally attached at boom pivots 198 and 200 to the collection receptacle 172. An hydraulic cylinder 202 is pivotally attached between the collection receptacle 172 at 204 and the outer boom arm 190 at 206 (rod end). Operating the boom tilting cylinder 202 rotates the extensible boom 182 and tilts the attached support arm 186 and container manipulator 184 to position an engaged container 208, FIG. 8, above the front and rear storage compartments 176 and 174, FIG. 9.

The support arm 186 is an articulated arm for lifting the container manipulator 184 and engaged container 208 above the collection receptacle 172. The support arm 186 includes an arm base 210 which is securely attached to the inner boom arm 188 and pivotally attached at arm pivots 214 to a lift arm 212 which is, in turn, pivotally attached to a manipulator base 216 at pivot joint 218. An hydraulic lift cylinder 220 is pivotally attached to the arm base 210 at cylinder pivot 222 and the lift cylinder rod 224, FIGS. 8 and 9, is pivotally attached at linkage pivot 226 to linkage rod 228 which is, in turn, pivotally attached to the manipulator base 216 at 230. Linkage bar 232 is pivotally attached to the arm base 210 at 234 and linkage bar 235 is pivotally attached to the lift arm 212 at 236. The linkage bars 232 and 235 are pivotally attached to the linkage rod 228 and the hydraulic cylinder rod 224 at linkage pivot 226. Extending the lift cylinder rod 224 pushes the linkage pivot 226 up and leverage from linkage bar 235 pivots the lift arm 212 about pivot 214 to lift the manipulator base 216. Linkage rod 228 is pushed to pivot the manipulator base 216 about pivot 218 for positioning the container 208 above the collection receptacle 172. A support arm of this type, described in conjunction with FIGS. 7–9, is described and shown in greater detail in U.S. patent application Ser. No. 08/411,494, now abandoned , filed Mar. 28, 1995, titled "Tilting Bin Handler", which was previously incorporated by reference. Of course, many other support arms could be used with this embodiment of the invention.

The container manipulator 184 is one of many that may be used in this embodiment of the invention. It includes inner manipulator arms 240 and 242 pivotally attached to the manipulator base 216 at pivots 244 and 246. Outer manipulator arms 248 and 250 are pivotally attached to the inner arms 240 and 242 at 252 and 254. The inner arms 240 and 242 are operated by connected hydraulic cylinders 256 and 258 and the outer arms 248 and 250 are operated by outer hydraulic cylinders 260 and 262. Pivotally attached to the manipulator base 216 and the inner arms 240 and 242 are suction cups, such as at 264. Rollers 266 are pivotally attached to the outer arms 248 and 250 and pads, such as at 268, are attached to the inner arms 240 and 242 and the manipulator base 216.

In one application, the collection apparatus 170 is carried by a refuse collection vehicle by fork receiving mounts 270 to various collection sites for picking up smaller containers, such as cans or bins. The collection vehicle is driven to a position alongside smaller containers of interest and the extensible boom 182 is extended to position the container manipulator 184 for addressing a container of interest 208. Container manipulator hydraulic cylinders 256, 258, 260 and 262 are extended to position the manipulator arms 240, 242, 248 and 250 around and grasp the container 208. The extensible boom 182 is retracted and the support arm lift cylinder 220 is operated to extend the cylinder rod 224 and lift the container manipulator 184 and container 208 above the collection receptacle 172. Simultaneously, the boom arm tilting cylinder 202 is operated to position the container 208 above either the forward storage compartment 176 or the rear storage compartment 174, as shown in FIG. 9 sans the container 208. This dumps the refuse from the container 208 into the appropriate storage compartment 174 or 176. The process is reversed to return the container 208 to its resting position.

Figure 10:
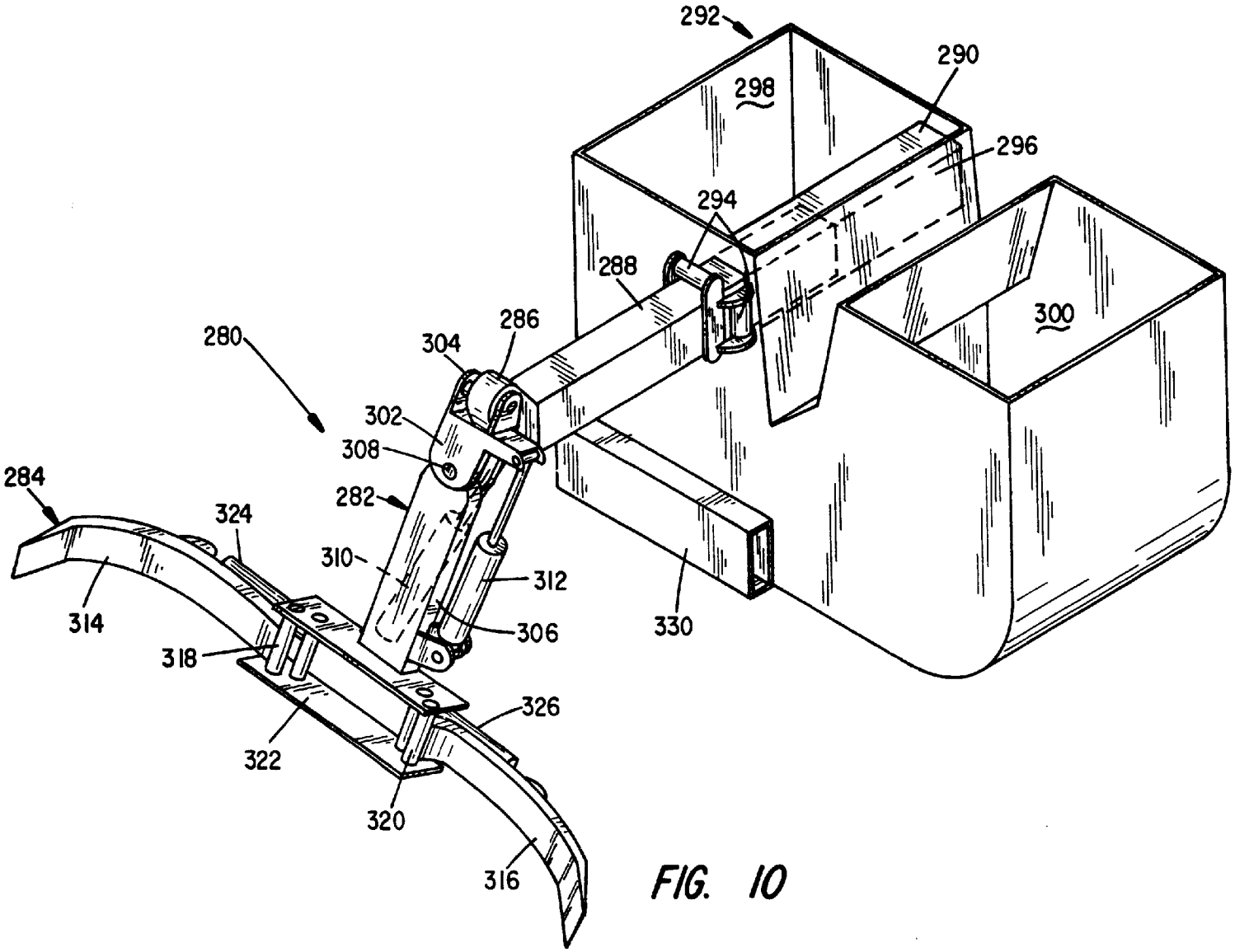
FIG. 10 is a perspective view of another embodiment of a collection apparatus of the invention showing a support arm having first and second pivots.
Figure 11:
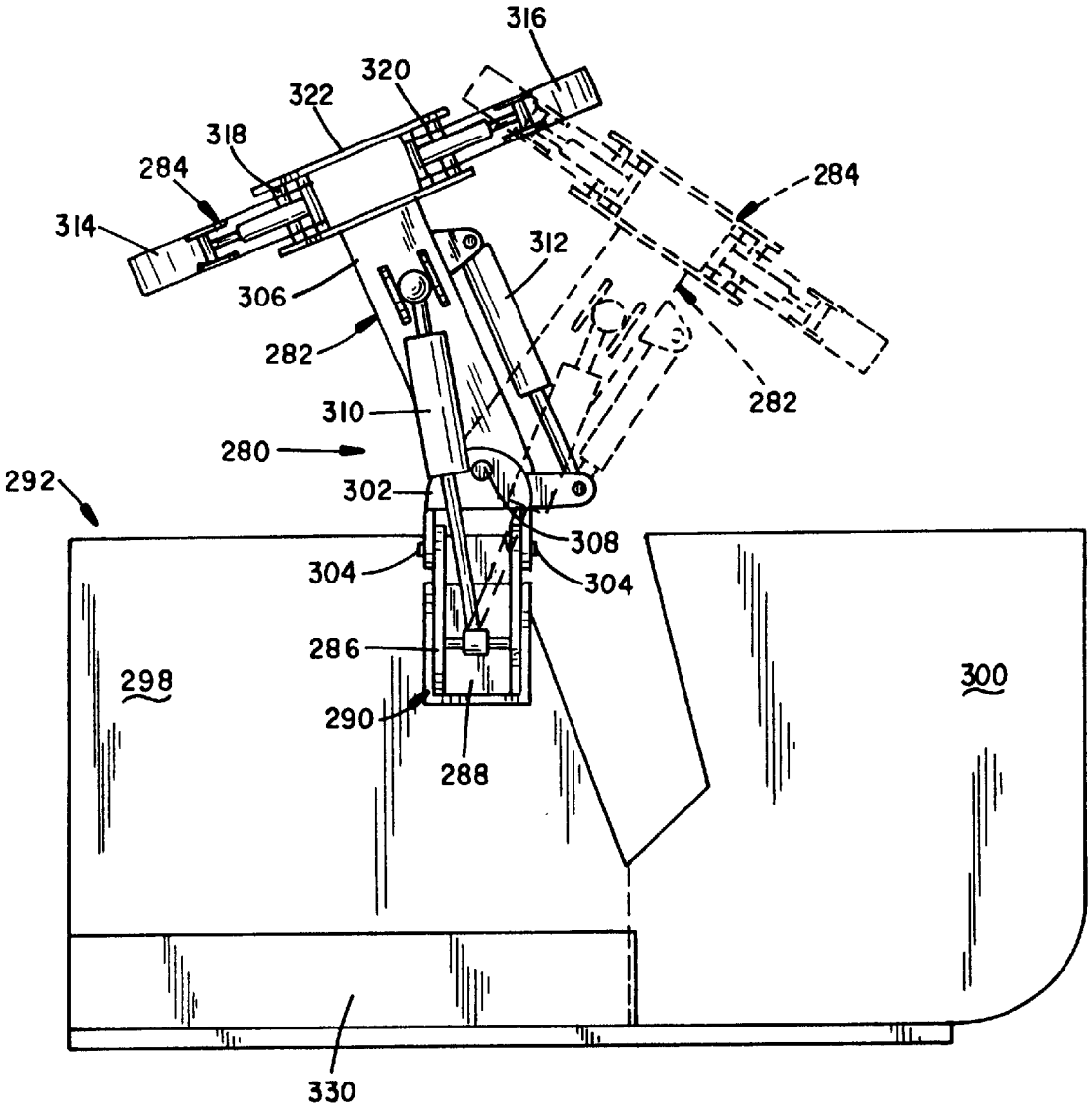
FIG. 11 is a side view of the collection apparatus of FIG. 10 showing the container manipulator in the raised position above one storage compartment in solid lines and the other storage compartment in dashed lines.

In another embodiment, as shown in FIGS. 10 and 11, the container lifting and emptying apparatus 280 includes a support arm 282 having multiple pivots for lifting and tilting a container manipulator 284. The support arm 282 includes an arm base 286 which is securely attached to the inner boom arm 288 of the extensible boom 290 which is attached to the collection receptacle 292. The extensible boom 290 is of the type previously described including the inner boom arm 288 which is guided by rollers 294 in and out of an outer boom 296. The collection receptacle 292 includes a forward storage compartment 300 and a rear storage compartment 298 wherein the extensible boom 290 is situated in the rear storage compartment 298.

The support arm 282 which lifts and tilts the container manipulator 284 includes a multiple pivot member 302 which is pivotally attached to the arm base 286 at 304 and to a pendulum arm 306 at 308. A lift hydraulic cylinder 310 is pivotally attached to the pendulum arm 306 and the arm base 286 to pivot the support arm 282 about 304 between a raised and a lowered position. A tilting or storage compartment shifting cylinder 312 is pivotally attached to the pendulum arm 306 and the multiple pivot member 302 for tilting the pendulum arm 306 and attached container manipulator 284.

It will be appreciated that the container manipulator 284 may be of any type and as shown includes two arms 314 and 316 which are pivotally attached at pivots 318 and 320 to a manipulator base 322 which is securely attached to the pendulum arm 306. Manipulator hydraulic cylinders 324 and 326 are pivotally attached between their respective arm 314 or 316 and the manipulator base 322 for operating the manipulator between a retracted or stowed (nested) position and an extended or grasping position.

In the preferred application, the collection receptacle is carried by a refuse vehicle from site to site for unloading smaller containers by inserting the forks of a fork-type, lift and dump mechanism into the fork receiving mounts 330 attached to the sides of the collection receptacle 292. Hydraulic fluid lines carried by the collection receptacle 292 are plugged into hydraulic fluid supply lines carried by the refuse vehicle. The container lifting and emptying apparatus 280 is aligned with a container of interest by moving the truck forward or backward and the extensible boom 290 is extended to position the container manipulator 284 for addressing the container. Manipulator cylinders 324 and 326 are extended to grasp the container and the extensible boom 290 is retracted to pull the container next to the collection receptacle 292. Lift cylinder 310 and tilting cylinder 312 are operated to lift the container above the collection receptacle 292 and position it over either the forward compartment 300 or the rear compartment 298. The container is returned to its resting position by reversing the process.

Figure 12:
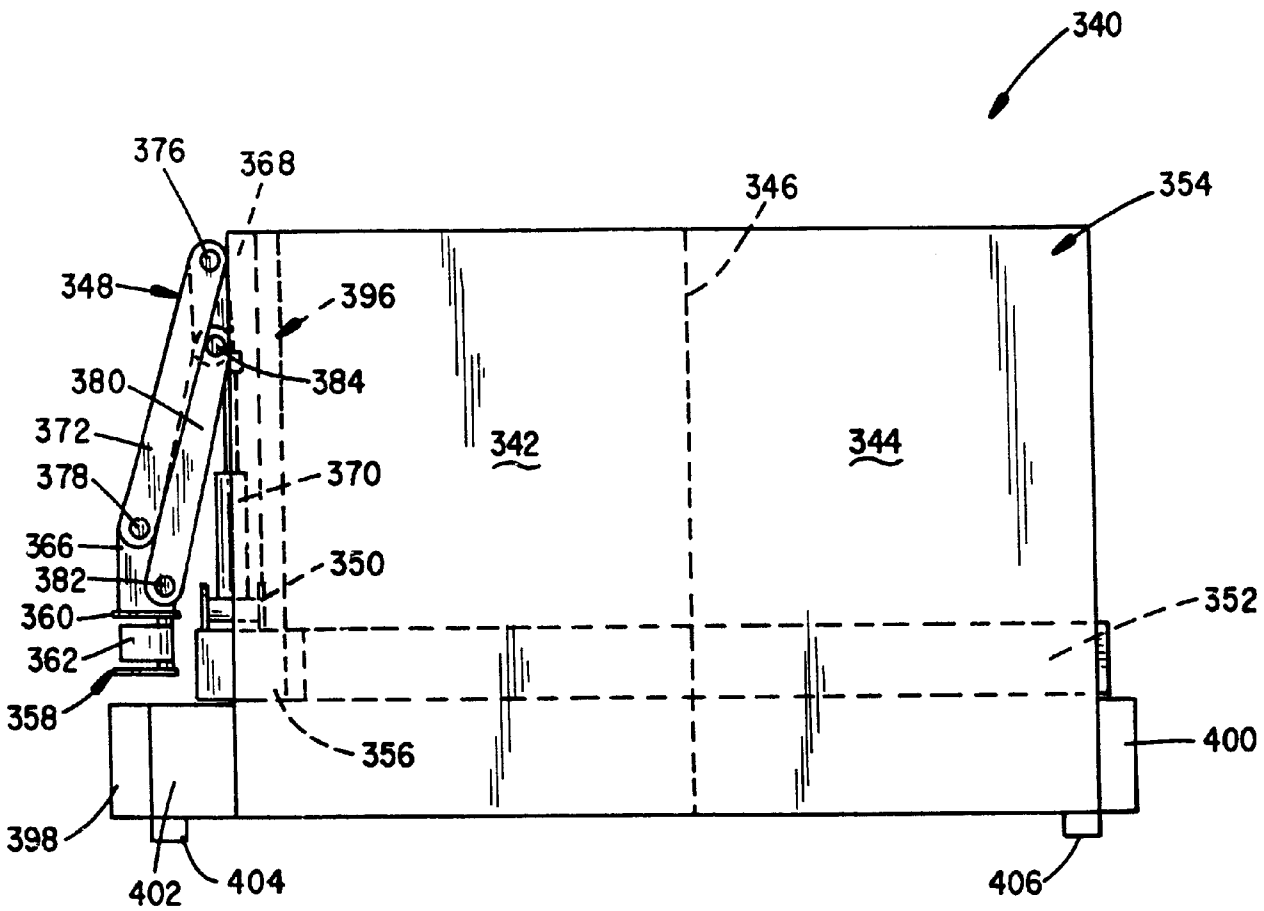
FIG. 12 is a front view of another embodiment of a collection apparatus of the invention having an adjacent or near storage compartment and a far storage compartment, and including a parallelogram support arm.
Figure 13:
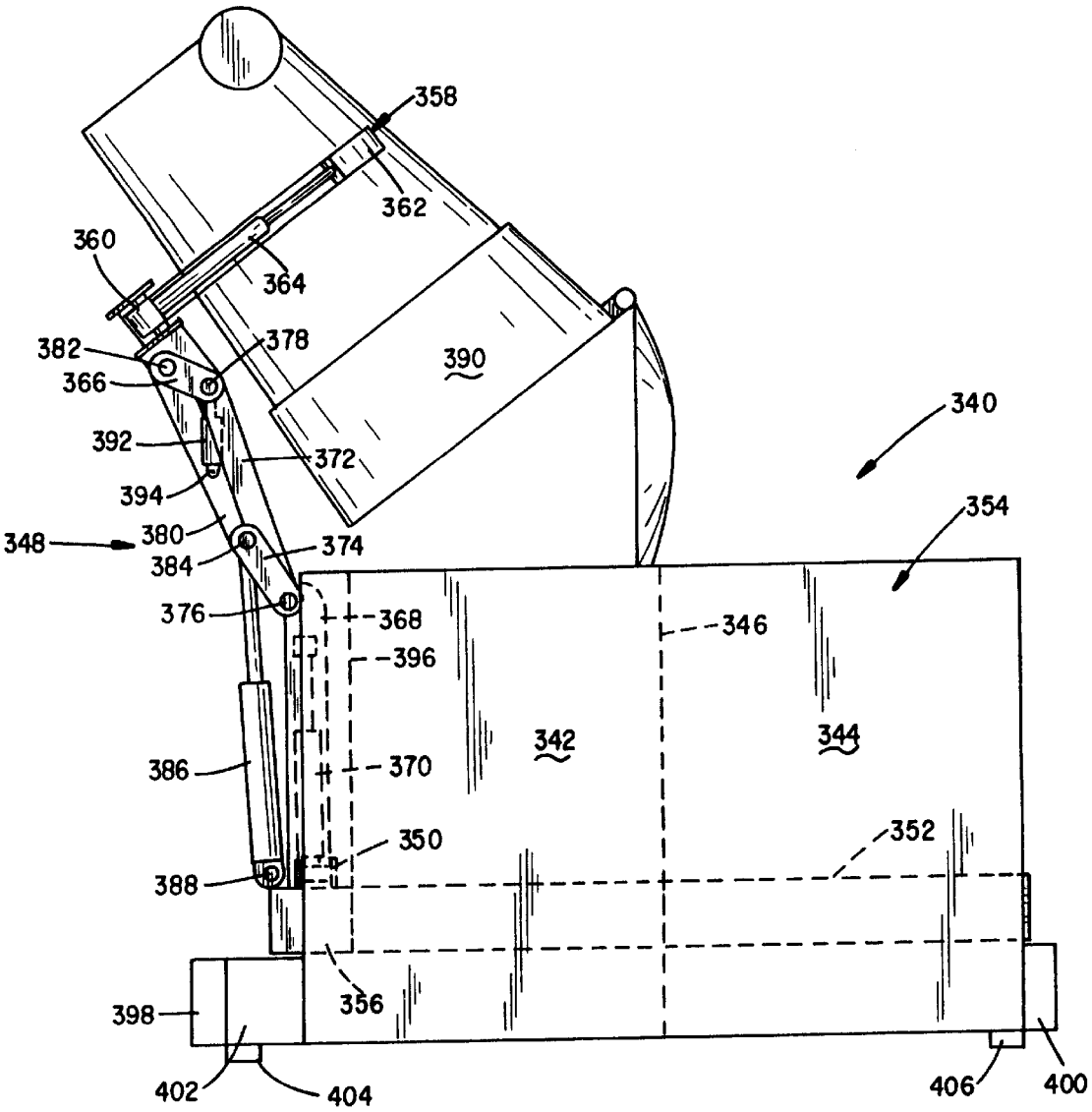
FIG. 13 is a front view of the collection apparatus of FIG. 12 including an engaged container in the raised position and the parallelogram arm in the retracted position for addressing the adjacent storage compartment.
Figure 14:
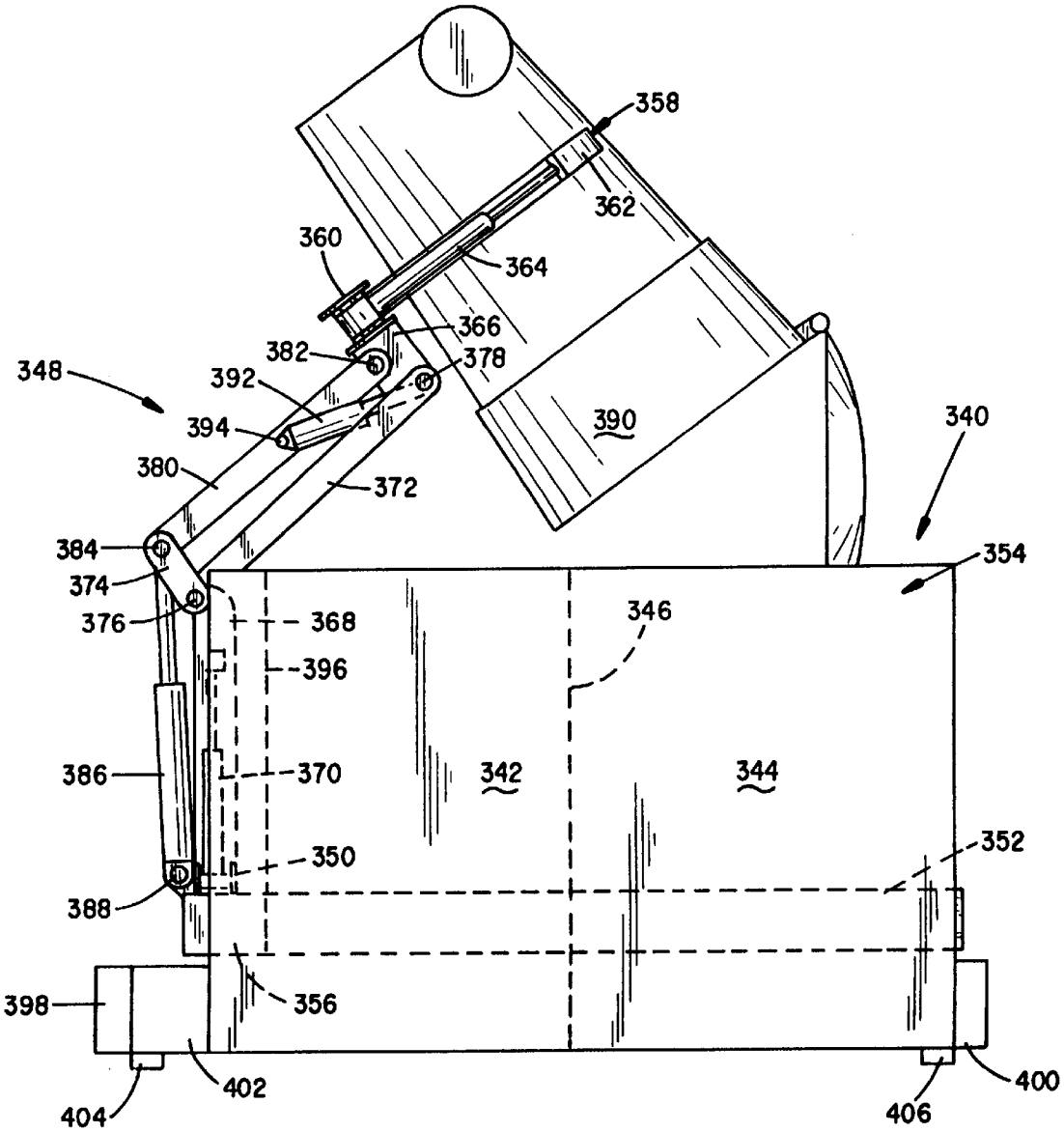
FIG. 14 is a front view of the collection apparatus of FIG. 12 showing the container in the raised position and the parallelogram arm extended to address the more remote storage compartment.

FIGS. 12–14 depict a collection apparatus 340 of a type which includes front and rear storage compartments wherein at least one of the front and rear compartments is further partitioned into side-by-side compartments 342 and 344 by vertical divider wall 346. The collection apparatus 340 includes a support arm 348 which is pivotally attached at pendulum pivot 350 to an extensible boom 352 secured to the collection receptacle 354. The extensible boom 352 is of a type previously described and the pendulum pivot 350 is mounted on the inner boom arm 356. A container manipulator 358 includes manipulator arms 362 pivotally attached to a manipulator base 360 and operated by a manipulator hydraulic cylinder 364 in a manner similar to that of the manipulator shown in FIG. 3. The manipulator base 360 is, in turn, attached to a manipulator linkage bar 366 which is part of the support arm 348.

In accordance with the present invention, the support arm 348 includes a base arm 368 which is pivotally attached at pendulum pivot 350 to the extensible boom 352. A tilting or front and rear storage compartment shifting hydraulic cylinder 370 is pivotally attached to the base arm 368 and the inner boom arm 356. The base arm 368 is further pivotally attached to a first lift arm 372 and a lift arm linkage bar 374 at pivot 376. The first lift arm 372 is further pivotally attached at 378 to the manipulator linkage bar 366 which is attached to the manipulator base 360 and pivotally attached to a second lift arm 380 at pivot 382. The second lift arm 380 is pivotally attached to the lift arm linkage bar 374 at pivot 384. Thus, a parallelogram is formed by the opposing first and second lift arms 372 and 380 and the opposing lift arm and manipulator linkage bars 374 and 366. A lift hydraulic cylinder 386 is pivotally attached to the base arm 368 at 388 and to the lift arm linkage bar 374 at pivot 384. A compartment shifting hydraulic cylinder 392 is pivotally attached to the second lift arm 380 at 394 and to the first lift arm 372 and manipulator linkage bar 366 at 378.

In operation, the lift cylinder 386 extends to pivot the lift arm linkage bar 374 and first lift arm 372 about 376 to lift the container manipulator 358 (and an engaged container 390) above the collection receptacle 354. The compartment shifting cylinder 392 is extended, while lift cylinder 386 is extended, to push the first lift arm 372 away from the second lift arm 380. This, pivots the first lift arm 372 about 376 and the engaged container 390 is moved from the near compartment 342, FIG. 13, to the far compartment 344, FIG. 14. The process is reversed to return the engaged container 390 to its resting position.

As shown in FIG. 12, the collection receptacle 354 includes a recess 396 into which the support arm 348 fits in its nested position. Fork receiving mount 400 is attached to one side of the collection receptacle 354 and fork receiving mount 398 is attached to a spacer member 402 which is attached to the other side of the collection receptacle 354. The spacer member 402 provides room for the container manipulator 358 and support arm 348 such that a fork-type lift and dump mechanism will not encounter the collection apparatus 340 as it is being unloaded. Feet 404 and 406 are attached under the spacer member 402 and the collection receptacle 354 for resting the collection apparatus 340 on the ground.

It will be appreciated that, the collection apparatus of the present invention may have more than two compartments which are aligned such that the container lifting and emptying apparatus can unload a container into any selected compartment. Also, the tubular fork receiving handles or mounts and the corresponding fork-type lift and dump mechanism could be replaced by other lifting means connected to any vehicle or refuse receiving body, such as a side loading refuse hauling vehicle.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A container handling system including apparatus for automatically unloading a container into a selected material receiving compartment in a multi-compartment collection receptacle, the apparatus comprising:

(a) said material receiving collection receptacle including walls and a floor and at least one intermediate partition for dividing the receptacle into a plurality of compartments;

(b) a container handling device carried by said collection receptacle for automatically engaging and unloading a container of interest into said collection receptacle, said container handling device further comprising:

(1) an automated support arm carried by said collection receptacle and pivotally operable in a first plane between a raised position and a lowered position, and a pivoting device connected between said support arm and said collection receptacle enabling said support arm to pivot in a second plane; and (2) a container manipulator attached to said support arm for engaging the container and moving between the raised and the lowered positions with said support arm, said pivoting device being further mounted for pivotally adjusting the attitude of said container manipulator in said second plane to determine and adjust the point of discharge of the engaged container to address the selected material receiving compartment.

2. The apparatus as in claim 1 wherein said support arm includes a collapsing parallelogram arm construction for moving between a retracted and an extended position, wherein said container manipulator is attached to said support arm and moved with said support arm between the retracted and extended positions.

3. The apparatus as in claim 2 further comprising a boom connected to the collection receptacle wherein said support arm is connected to said boom.

4. The apparatus as in claim 3 wherein said support arm is pivotally attached to said boom for pivotally adjusting the attitude of said container manipulator.

5. The apparatus as in claim 3 wherein said boom is pivotally attached to the collection receptacle for pivotally adjusting the attitude of said container manipulator.

6. The apparatus as in claim 1 wherein said pivoting device further comprises a pivotally mounted member connected between said support arm and the collection receptacle and a linear operator for pivotally adjusting the attitude of said support arm and container manipulator.

7. The apparatus as in claim 6 wherein said support arm has a plurality of segments.

8. The apparatus as in claim 6 further comprising a boom connected to the collection receptacle and wherein said support arm is connected to said boom.

9. The apparatus as in claim 8 wherein said support arm is pivotally attached to said boom for pivotally adjusting the attitude of said support arm and said container manipulator.

10. The apparatus as in claim 8 wherein boom is pivotally attached to the collection receptacle for pivotally adjusting the attitude of said container manipulator.

11. The apparatus as in claim 1 wherein said pivoting device for said support arm includes a pendulum lever having a fulcrum spaced from said container manipulator for pivotally adjusting the attitude of said container manipulator.

12. The apparatus as in claim 11 further comprising a boom secured to the collection receptacle wherein said support arm is secured to said boom.

13. The apparatus as in claim 1 wherein said support arm has a plurality of segments.

14. The apparatus as in claim 1 wherein said system is operated by a plurality of hydraulic cylinders.

* * * * *